United States Patent [19]

Flesher et al.

[11] Patent Number: 4,859,720

[45] Date of Patent: Aug. 22, 1989

[54] PROCESS AND COMPOSITIONS FOR SIZING PAPER

[75] Inventors: Peter Flesher; John Langley; Norma Rosier; David Farrar, all of West Yorkshire, England

[73] Assignee: Allied Colloids Ltd., England

[21] Appl. No.: 11,062

[22] Filed: Feb. 4, 1987

Related U.S. Application Data

[63] Continuation-in-part of Ser. No. 857,115, Apr. 29, 1986, abandoned, and a continuation-in-part of Ser. No. 667,950, Nov. 5, 1984, abandoned.

[30] Foreign Application Priority Data

Nov. 7, 1983 [GB] United Kingdom ..... 8329655
May 3, 1985 [GB] United Kingdom ..... 8511379

[51] Int. Cl.[4] ..... C08J 3/00
[52] U.S. Cl. ..... 523/332; 524/112
[58] Field of Search ..... 524/112; 523/332

[56] References Cited

U.S. PATENT DOCUMENTS

| | | | |
|---|---|---|---|
| 4,207,142 | 6/1980 | Shepherd | 162/158 |
| 4,214,948 | 7/1980 | Mazzarella et al. | 162/158 |
| 4,279,794 | 7/1981 | Dumas | 524/112 |
| 4,431,826 | 2/1984 | Sweeney | 162/158 X |
| 4,514,229 | 4/1985 | Sato et al. | 524/112 X |
| 4,545,855 | 10/1985 | Sweeney | 162/158 |
| 4,645,568 | 2/1987 | Kurps et al. | 523/332 |

FOREIGN PATENT DOCUMENTS

| | | | |
|---|---|---|---|
| 2439026 | 2/1975 | Fed. Rep. of Germany | 162/158 |
| 0045730 | 3/1983 | Japan | 524/112 |
| 0045731 | 3/1983 | Japan | 524/112 |

*Primary Examiner*—Joseph L. Schofer
*Assistant Examiner*—J. M. Reddick
*Attorney, Agent, or Firm*—Ostrolenk, Faber, Gerb & Soffen

[57] ABSTRACT

A concentrate composition, that can be diluted with water to form an aqueous size for cellulosic fibres, comprises a substantially anhydrous dispersion of polyelectrolyte particles in a non-aqueous liquid comprising a reactive size, and is made by forming a dispersion in a hydrophobic liquid of the polyelectrolyte particles while they are swollen by water, azeotroping the dispersion and adding the size to the hydrophoboic liquid. If the size is a liquid size, the hydrophobic liquid may be removed from the composition. The dispersion of swollen polyelectrolyte particles in the hydrophobic liquid can be amde by dispersing a solution of polyelectrolyte in the liquid but is preferably made by reverse phase polymerization.

17 Claims, No Drawings

PROCESS AND COMPOSITIONS FOR SIZING PAPER

This application is a continuation-in-part of U.S. Ser. No. 667,950 filed Nov. 5, 1984 and a c-i-p of U.S. Ser. No. 857,115 filed Apr. 29, 1986, both now abandoned.

The invention relates to the sizing of cellulosic fibres and to compositions for use in this, and to their manufacture.

During the manufacture of paper it is necessary to render the naturally hydrophilic cellulosic fibres hydrophobic so that penetration of aqueous liquids into the formed sheets is limited thereby making writing and printing on the sheets possible. This process, known as sizing, can be carried out by adding a sizing agent to the pulp slurry (usually termed internal sizing) or the sizing agent can be applied to the formed paper sheet. This invention is concerned with the internal sizing process.

There are two types of sizing agent in general use. One of these is based on rosin which is used in conjunction with alum. The rosin is added as a soap solution or as an emulsion and alum is added afterwards just prior to sheet formation to precipitate the rosin as a fine particulate which is retained by the sheet.

The second type of size is a reactive size, such as a ketene dimer or an anhydride-based size, which reacts chemically with the cellulosic fibres. Preferably it is applied in combination with a polyelectrolyte which will help to retain the size in the sheet.

The reactive size is generally added to the pulp in the form of an aqueous emulsion, generally a cationic emulsion. The emulsion can be prepared at the mill but this necessitates the mill having emulsifying equipment and so it would be more convenient if a concentrated emulsion could be supplied to the mill ready for dilution and use. Unfortunately, reactive sizes tend to react with water so that an aqueous emulsion is liable to be rather unstable.

Anhydride based sizes, such as alkenyl succinic anhydride sizes, are so reactive that their emulsions have to be prepared at the mill just prior to use. These sizes are normally supplied to the mill with a cationic starch which generally has to be precooked before emulsification, thus making it even less convenient for the emulsion to be formed at the mill.

Ketene dimer sizes often are supplied to the mill in the form of an emulsion but these emulsions have only limited shelf-life and the maximum concentration of ketene dimer in the emulsion is rather low, generally below 6%, so that very large volumes of emulsion have to be supplied to the paper manufacture.

Emulsification of liquid ketene dimers can be achieved using conventional emulsification equipment but some of the preferred ketene dimers are solids at ambient temperature. As described in U.S. Pat. No. 3,046,186, emulsification of these necessitates initially either melting the solid (so that upon cooling the emulsion is converted to a dispersion) or dissolving the solid in a solvent, generally benzene. A typical important ketene dimer is distearyl ketene dimer and this has only relatively low solubility in organic solvents with the result that the solution of it that is emulsified must be rather dilute. For instance, we have found that this dimer precipitates from a 40% by weight solution in benzene (weight ratio benzene:dimer of 1:0.67) and so any solution in benzene must be much more dilute than this. Also this dimer is less soluble in other organic solvents than it is in benzene.

As described in U.S. Pat. No. 3,046,186, the emulsions are generally prepared by emlsifying the dimer into an aqueous solution of cationic dispersing agent although that patent does mention that in certain instances the emulsifying agent may be predispersed in the ketene dimer. It is stated that the emulsions may be prepared at any convenient solids content but are used at 1 to 5% solids by weight.

In each of the examples in U.S. Pat. No. 3,046,186, the initial composition that was prepared and that contained both size and polyelectrolyte was very dilute. For instance in Example 1 the initial concentration is about 9% by weight size based on the total composition.

As mentioned above, it is preferred to provide a polyelectrolyte with the reactive size and it might be thought that some of the disadvantages associated with providing emulsions of reactive size and polyelectrolyte could be minimised if the reactive size and the polyelectrolyte were supplied separately. However this incurs other disadvantages.

It would therefore be very desirable if it was possible to supply a stable concentrated composition that contained both reactive size and polyelectrolyte and which was readily dilutable with water at the mill.

A concentrate composition according to the invention comprises a substantially anhydrous dispersion of a polyelectrolyte in a non-aqueous liquid comprising a reactive size. If the reactive size is liquid, the non-aqueous liquid may consist of the size, in the substantial absence of solvent. Often, however, the non-aqueous liquid is a solution of the size in a hydrophobic liquid. The composition is best made by dissolving the reactive size in a substantially anhydrous dispersion of the polyelectrolyte in a hydrophobic liquid. The dispersion is best made by reverse phase polymerisation.

The concentrate composition generally has a reactive size concentration above 20% and preferably at least 28.6%. The concentration of reactive size is often in the range 30 to 60%. The amount may be higher, for instance up to 80% or 85%. All these amounts are by weight of the total composition.

The weight ratio, on a dry basis, of polyelectrolyte:-reactive size is generally from 1:1 to 1:10, preferably 1:1.5 or 2 up to 1:4 or 1:5.

When the liquid phase comprises hydrophobic solvent, in order that the concentrate can conveniently have an appropriately high active content it is necessary for the weight of reactive size to be at least 0.67 part per part by weight organic solvent (i.e. 40% solution). The weight ratio organic solvent:reactive size is generally from 1:10 to 1:0.67 preferably 1:1 to 1:3.

With the most dilute solution of reactive size in solvent that is generally used in the invention (40 parts size to 60 parts solvent), the amount of polyelectrolyte is generally between 4 parts and 40 parts, giving sizing compositions having a reactive size content of from 38.4 to 28.6%. A composition having 83.3% reactive size can be formed from, for instance, 100 parts reactive size, 10 parts solvent and 10 parts polyelectrolyte.

Preferred compositions that contain solvent have, per part solvent, about 1 to 3 parts (preferably about 2 parts) reactive size and about 0.5 to 2 parts (preferably about 1 part) polyelectrolyte.

In the compositions according to the invention that are substantially free of solvent, at least 80%, preferably at least 85% or at least 90%, consists of the polyelectrolyte and the liquid size. Preferred compositions contain from 45 to 90%, preferably 60 to 80%, by weight reactive size, 10 to 50%, preferably 20 to 40%, by weight polyelectrolyte and optionally up to 15%, e.g., 5 to 10% additives.

The compositions may contain minor additives such as 0.5 to 5% stabiliser and/or water-in-oil emulsifiers and oil-in-water emulsifier.

The concentrate composition must be substantially anhydrous in order that the composition is stable, and in practice this means that if water is present its amount will be not more than about 5% by weight of the composition. Preferably the water content is not more than about 1% or, at the most, about 2% by weight of the composition. The amount of water is insufficient to form a solution of the polyelectrolyte and preferably is not significantly more than, and most preferably is the same as or less than, the equilibrium moisture content of the polyelectrolyte (i.e. the water content of the electrolyte if it is exposed in the form of dry powder to the ambient atmosphere).

When the liquid phase in which the polyelectrolyte is dispersed is a solution of the reactive size in an organic liquid, this liquid should be a hydrophobic solvent. Suitable solvents are water immiscible organic hydrocarbon liquids such as benzene, xylene, toluene, mineral oils, kerosene, and vegetable oils. In addition to being substantially free of water, the composition is preferably also substantially free of any highly polar liquids with which the reactive size might tend to react. Preferably the liquid phase of the composition consists essentially only of the size and, if desired or necessary, hydrophobic solvent.

When the size is solid, the liquid phase must be a solution of the size in hydrophobic solvent. When the size is liquid, the liquid phase can be provided by the size alone or by a solution of the size in hydrophobic solvent. If the liquid phase is to be provided by the size alone (e.g., below 5%, and usually below 1%, solvent by weight of the composition) the size must be liquid at the temperature at which the composition is used or stored such as 20° to 25° C., and preferably it is liquid at 0° C.

Any type of reactive size may be used in the invention but the size preferably is a ketene dimer reactive size or an anhydride reactive size.

Suitable ketene dimer reactive sizes that may be used include the dimers derived from readily available commercial fatty acids such as palmitic, stearic, oleic or myristic acids or mixtures thereof. Naturally the keten dimer either be a liquid or, more usually, must be soluble in the organic liquid chosen for the polymer-in-oil dispersion. Suitable materials are well known and are described in, for example, U.S. Pat. No. 3,046,186. The ketene dimer may be solid or liquid, but generally the most concentrated products are obtainable when the dimer is liquid.

Suitable anhydride reactive sizes that may be used include alkenyl succinic anhydride sizes. Suitable materials are described in U.S. Pat. No. 3,102,064.

If the composition is to be substantially free of solvent, it is usually preferred for the size to be a liquid anhydride size, although some liquid ketene dimer sizes can be used.

The polyelectrolyte will generally be water soluble and an advantage of the invention is that it can have a any desired molecular weight and in particular can have a molecular. weight that is higher than is conveniently possible with existing compositions. For instance, the intrinsic viscosity can typically be above 1 and generally above 3, e.g., above 6. Although it is generally below 9 it can be higher, e.g., up to 20 or more.

The polyelectrolytes may be cationic or anionic, the cationic polyelectrolytes generally being preferred.

Preferred cationic electrolytes include homopolymers or copolymers of diallyl dialkyl (generally dimethyl) ammonium chloride and homopolymers and copolymers of dialkylaminoalkyl (meth) acrylates and (meth)carylamides (preferably dimethylaminoethyl acrylates and methacrylates) present as acid addition salts or quaternary ammonium salts, generally quaternised with methyl chloride or dimethyl sulphate. Copolymers of such monomers may be formed with acrylamide or methacrylamide and will typically contain at least 10%, and usually at least 30%, by weight of the cationic monomer. Other cationic (meth) acrylamides and other cationic polymers obtained by polymerising one or more ethylenically unsaturated monomers can be used. Other cationic polymers that can be used are polyamines and polyimines such as polyamine-epihalohydrin polymers and dicyandiamide condensates and polyethylene imines.

Suitable anionic polymers include polymers formed from monomers including carboxylic or sulphonic acid groups. These groups may be present as free acid or, more usually, as a water soluble ammonium or alkali metal (generally sodium) salt. Suitable acids are acrylic acid, methacrylic acid and 2-acrylamido-2-methyl-propane sulphonic acid. The anionic polymers may be homopolymers of such acids, or mixtures thereof, or copolymers with, for instance, acrylamide. A suitable polymer is polyacrylamide containing up to 25% or more acrylic acid groups.

The concentrate composition is best made by adding the reactive size to a substantially anhydrous dispersion of a polyelectrolyte in the hydrophobic liquid and thereby forming a solution of the size in the hydrophobic liquid. If the concentrate is to include solvent for the size then the resultant composition can be used without further treatment, although if desired additional hydrophobic liquid can be added and/or some of the hydrophobic liquid can be removed by, for instance, distillation.

If the concentrate is to be substantially free of solvent, then it is necessary to remove the solvent after adding the size and in such processes it is desirable that the solvent used initially as the continuous phase of the dispersion should be a volatile non-aqueous liquid, generally a volatile aliphatic hydrocarbon.

The dispersion of the polyelectrolyte particles in the hydrophobic liquid is best made by forming a dispersion in the hydrophobic liquid of the polyelectrolyte particles swollen by water and then dehydrating this dispersion, generally by azeotroping. This dispersion may be made by dispersing aqueous polymer solution into the hydrophobic liquid in the presence of water-in-oil emulsifier and optionally with other stabiliser, e.g., an amphipathic polymeric stabiliser. For polymers, e.g., of acrylic monomers, that can be made by reverse phase polymerisation, the dispersion is preferably made by reverse phase polymerisation. Thus an aqueous solution of the monomer or monomers from which the polyelectrolyte is to be formed may be dispersed in an oil phase and then polymerised by emulsion or suspension polymerisation mechanism to form aqueous gel polymer droplets dispersed in the oil phase, and the composition is then dried.

The dry particle size of the dispersion of polyelectrolyte in organic liquid should be typical for reverse phase processes, i.e., below 10 μm, and often below 3 μm. Thus at least 90% by weight should be below 3 μm. Preferably it is below 2 μm, often mainly in the range 0.05 to 1 μm. This very low particles size promotes the formation of a stable dispersion without the need for large amounts of stabiliser. The problems of dusting and mixing, that would be associated with the use of dry powder of this size, are avoided by first forming a dispersion of these particles in organic liquid and then adding the size.

The dispersion is best made by reverse phase polymerisation, generally reverse phase suspension polymerisation, of water soluble monomer or monomer blend dispersed in water immiscible organic liquid.

The reverse phase polymerisation may be conducted in the presence of an oil soluble polymer, generally an amphipathic polymer, as a dispersion stabiliser and this stabiliser may also promote the stability of the final dispersion in the liquid size. The reverse phase polymerisation may also be conducted in the presence of a water in oil emulsifier. Materials and processes for reverse phase polymerisation are well known and are described in, for instance, EP No. 0126528.

It appears that the presence of residues of the described stabilisers on the polymer particles are important for stabilising the concentrates and so even if the concentrate is made by dispersing a solution of polyelectrolyte into the organic liquid, followed by azeotroping, preferably amphipathic polymer is included in that emulsion.

Preferred polymerisation stabilisers are copolymers of one or more hydrophobic ethylenically unsaturated monomers with one or more hydrophilic ethylenically unsaturated monomers. They include polyhydroxy stearic acid-polyethylene glycol condensates, maleic polymers such as those described in U.S. Pat. No. 4,339,371 and, preferably, copolymers of hydrophilic acrylic monomers and hydrophobic acrylic monomers such as those described in GB No. 1,482,515 or EP No. 0126528.

It is particularly advantageous in the invention to use an azeotroped polyelectrolyte dispersion in hydrophobic liquid as the means for supplying the polyelectrolyte, rather than using any other form of polyelectrolyte. If the polyelectrolyte is merely dissolved in aqueous solution and is then blended with the size, a conventional aqueous emulsion will be obtained, rather than the anhydrous concentrates of the invention. If the polyelectrolyte is provided as a powder, the concentrate will generally have a tendency towards settlement upon storage and so either must be used quickly, before serious settlement occurs, or an appropriate dispersion promoter must be added in an effective amount, e.g., 0.01 to 10%. Unlike the amphipathic polymeric stabilisers that are soluble in the oil phase, many of these dispersion promoters are insoluble and typically are clays and other silica based dispersion stabilisers known for stabilising dispersions of particles in oil. However the inclusion of these additional stabilisers is inconvenient, detrimentally affects the viscosity and flow properties of the concentrates, and results in unwanted material being introduced into the aqueous suspension that is sized by the composition.

A user composition is made from the concentrate composition, generally by the user, by adding the concentrate composition to water and thereby forming an oil-in-water emulsion of the size solution dispersed in water in which the polyelectrolyte is dissolved. Formation of the oil-in-water emulsion is promoted by application of mechanical high shear and/or by the presence of an oil-in-water emulsifying agent, such as an ethoxylated nonyl phenol. The oil-in-water emulsifying agent may be included in the concentrate or in the water in which the emulsion is formed.

The water in which the emulsion is formed may be the water of the cellulosic pulp suspension that is to be treated but preferably the concentrate is first converted into an aqueous emulsion to give a reactive size concentration of from 0.01 to 5%, preferably 0.05 to 1%, based on the weight of the aqueous solution.

This emulsion may then be added to the aqueous cellulosic pulp, and paper may be made from it, in the usual way. The amount of reactive size in the aqueous pulp is generally from about 0.01 to about 1% by weight based on the dry weight of the pulp. Upon addition to the pulp slurry, the active size/oil droplets are retained by the polymer on the fibres and the size reacts with the fibres. The size released from an emulsion in this way produces results at least as good as those obtained with the conventional ketene dimer emulsions.

Thus by the invention we obtain sizing results at least as good as those obtained using known compositions and yet for the first time we have the ability of supplying storage stable concentrated compositions that the user can easily convert into aqueous solutions.

The following are examples of the invention.

Polyelectrolyte Dispersions

A substantially anhydrous dispersion of a copolymer of methyl chloride quaternised dimethylaminoethyl methacrylate (DMAEMA) and acrylamide was prepared by a reverse phase dispersion polymerisation process. The acrylamide was supplied as a 57% aqueous solution and the quaternised monomer was a 65% aqueous solution. These solutions were dispersed in a blend of Solvent Pale Oil 150 and perchloroethylene in the presence of a polymeric amphipathic stabiliser and a very small amount of emulsifier, in known manner. Polymerisation was initiated and allowed to complete in conventional manner and the resultant product was distilled under reduced pressure to remove the water and the perchloroethylene. The Intrinsic Viscosity of this polymer (and of the polymers in each of Dispersions A to E below) was in the range 4 to 6.

In one process, the ratio DMAEMA:acrylamide was 80:20 by weight and the resultant polymer dispersion, labelled Dispersion A, contained 47.5% by weight of active polymer. A 1% solution of the polymer in water had a RVT Brookfield Viscosity of 6,400 cps at room temperature using spindle No. 3 rotating at 10 rpm.

In another experiment, the monomer proportions were the same and the molecular weight of the resultant polymer was above 106 The resultant dispersion was labelled Dispersion B.

In another process, a dispersion, labelled Dispersion C, was obtained broadly as described for Dispersion A and was a 50% active polymer dispersion in mineral oil.

In another process, the ratio DMAEMA:acrylamide was 30:70 by weight and the resultant dispersion, labelled Dispersion D, contained 50% by weight active polymer. The polymer in the dispersion was of low molecular weight, having an intrinsic viscosity of 3.16.

In another process, a substantially anhydrous dispersion of a polyamine-epichlorhydrin condensate was prepared by emulsifying the polymer produced in an aqueous phase polymerisation process into a mixture of solvent pale oil 60 and SBP 11 with a very small amount of emulsifiers prior to distilling off the water under reduced pressure. The resultant polymer dispersion, labelled Dispersion E, contained 37.6% by weight of active polymer.

EXAMPLES 1 to 5

A series of concentrate compositions according to the invention were made by dissolving a reactive size in each of Dispersions A to E.

In Example 1, the size was hexadecenyl dimer and the concentrate contained 1.05 g Dispersion A and 4 g of hexadecenyl ketene dimer, and 1 g of an oil-in-water emulsifier to give a 64.5% active sizing composition. The water content of the concentrate was less than 1%. The product is concentrate A.

In Example 2, the concentrate was made by mixing 2 ml of Dispersion B with 2 ml octadecenyl ketene dimer, to make concentrate B.

In Example 3, one part by weight Dispersion C was mixed with one part by weight alkenyl succinic anhydride reactive size to form concentrate C.

In Example 4, alkenyl succinic anhydride was dissolved into a mixture of Dispersion D and a mineral oil such that concentrate D contained 2 g Dispersion D, 5 g alkenyl succinic anhydride, 2.25 g mineral oil and 0.75 g of an oil-in-water emulsifier to give a 50% active sizing concentrate D, having a water content of less than 1%.

In Example 5, alkenyl succinic anhydride was dissolved into Dispersion E in the presence of emulsifiers to form concentrate E containing 5 g alkenyl succinic anhydride, 5.31 g Dispersion E and 1.28 g of the oil-in-water emulsifiers to give a 43.1% active size concentrate.

Each of concentrates A to E was used to prepare a corresponding aqueous emulsion, having a 1% by weight active size content, by stirring the appropriate amount of dispersion into water. Each of these 1% active emulsions was further diluted to 0.1% by weight active size content and these 0.1% emulsions were labelled Emulsions A to E (having been prepared from, respectively, concentrates A to E).

The effectiveness of each of the emulsions for sizing cellulosic fibres was determined by the 1 minute Cobb Test. In each of these tests, hand sheets were prepared on a standard laboratory sheet making machine from a stock containing calcium carbonate and the sheets were then dried and the 1 minute Cobb value determined. For Emulsions A to D, the stock was a bleached sulphate/bleached bird stock but for Emulsion E it was a bleached sulphate (kraft).

In Test A, the hand sheets were 100 g.sm and the stock contained 20% calcium carbonate and was a 0.5% constituted stock. The emulsion was either Emulsion A or, as a comparison, with Emulsion F which was a conventional emulsion prepared from a commercially available 6% emulsion of ketene dimer in water stabilised with cationic starch.

In Test B, hand sheets were prepared from a stock of 50% bleached sulphate, 40% bleached birch and 10% calcium carbonate, beaten to a freeness of 52° S.R. The stock was sized with Emulsion B or, as a comparison, with Emulsion G obtained by mixing 2 ml of the 50% dispersion of polymer in oil used in the preparation of Dispersion B into 196 mls deionised water followed by rapid stirring with a Silverson mixer at maximum speed and injection into the resultant solution of 2 mls octadecenyl ketene, Silverson mixing being continued for a further 25 seconds. The resultant 1% emulsion was diluted to 0.1% to form Emulsion G.

In Test C, 70 gsm hand sheets were prepared from a stock of 50 parts bleached sulphate, 40 parts bleached birch and 10 parts calcium carbonate and these were sized either with Emulsion C or with comparison Emulsion H. This was prepared as follows. A 12% aqueous dispersion of a cationic starch was cooked at 95° C. for 20 minutes with constant stirring. The cooked starch was cooled and diluted to 9% activity. 2 parts by weight of alkenyl succinic anhydride was added to 3 parts by weight of cationic starch with agitation. High shear mixing using a Silverson mixer was continued to achieve a fine particle size emulsion. This emulsion was diluted with water to 0.75% active size, which was further diluted to 0.1%.

In Test D, 70 gms hand sheets were prepared from a stock of 50 parts bleached sulphate, 40 parts bleached birch and 10 parts calcium carbonate beaten to 50° S.R. and after manufacture, the sheets were placed on glazing plates and pressed at 3.5 kg/cm for 5 minutes prior to drying on rings at 110° C. for 2 hours. Emulsion D was used for sizing each of these sheets.

In Test E, 70 gms hand sheets were prepared from a bleached sulphate stock in conventional manner and dried and pressed as in Test D, the sheets being sized using Emulsion E.

The dosage and the Cobb value are shown in the following Table. The dosage is recorded as percent active size based on dry weight of paper. The Cobb figure is the 1 minute Cobb value.

| Test | Emulsion | Dose | Cobb |
|---|---|---|---|
| A | A | 0.15 | 27.4 |
| | A | 0.2 | 25.8 |
| | F | 0.15 | 33.2 |
| B | B | 0.2 | 26 |
| | G | 0.2 | 65 |
| C | C | 0.3 | 21.2 |
| | C | 0.4 | 19.4 |
| | H | 0.3 | 21.6 |
| | H | 0.4 | 19.8 |
| D | D | 0.2 | 25.6 |
| | D | 0.3 | 17.0 |
| | D | 0.5 | 14.3 |
| E | E | 0.5 | 36.2 |

These results show that the methods and emulsions of the invention, A to E, are all capable of giving satisfactory sizing. Test C shows that the results can be similar to those obtainable with a conventional commercially available 2-pack system H while Test B shows that the results can be surprisingly better than the results obtained by sequential formation of a single emulsion, G. Test A shows that the results can be better than obtainable with a conventional emulsion system. Similarly satisfactory results are obtained when the polymer is polyacrylamide containing 10% molar acrylic acid groups (as sodium salt) and the stock contains alum and has a pH of 5.5.

Additional to these results is the remarkable convenience of the invention to the mill operator in that instead of having to purchase or prepare large volumes of a dilute emulsion, which then have to be stored at the mill, it is possible for the mill operator to purchase or prepare small volumes of a very concentrated emulsion and merely dilute this at the point of use when required.

EXAMPLE 6

(Comparative)

A polyelectrolyte, a copolymer of methyl chloride quaternised dimethyl aminoethylmethacrylate and acrylamide (25:75 by weight), was prepared by bulk solution polymerisation. The resulting polymer gel was cut into particles less than 5 mm in dimension, dried on a fluid bed drier and then ground down to the required dimension of less than 53 microns.

A sizing concentrate was prepared, including alkenyl succinic anhydride as the active sizing constituent, by dispersing the powdered polyelectrolyte into the liquid sizing component to which had been added an oil-in-water emulsifying surfactant.

The chosen alkenyl succinic anhydride was a liquid at ambient temperature and did not require melting to allow the dispersion to take place.

The composition comprised 65 g of alkenyl succinic anhydride, 10 g of oil-in-water emulsifying surfactant, and 12.5 g of polyelectrolyte to give a 74.3% active sizing composition. The composition was ostensibly free from water.

It settled rapidly on storage and so had to be used very quickly after manufacture.

2.7 g of the concentrate composition was, quickly after manufacture, added to 197.3 g of water with stirring to give a 1% active alkenyl succinic anhydride emulsion which was used to carry out 1 minute Cobb tests. This emulsion was labelled I.

For this test, 100 gsm handsheets were prepared from a bleached sulphate/bleached birch stock containing 10% calcium carbonate loading, on a Standard Laboratory sheet making machine. Prior to sheet formation, the required amount of 1% alkenyl succinic anhydride emulsion as prpeared above was added to 600 mls of 1.0% consistency stock. After stirring, handsheets were prepared on the standard sheet-making machine. The sheets were couched off the sheet-machine in the normal manner placed on glazing plates and pressed at 50 psi for 5 minutes prior to drying on rings at 110° C. for 1 hour. After conditioning at room temperature, the degree of sizing achieved was measured by the standard 1 minute Cobb test. The results are shown in the table below.

| Emulsion | Dose Level of Alkenyl Succinic Anhydride based on Dry Fibre and Filler | 1 Minute Cobb Value ($g \cdot m^2$) |
|---|---|---|
| I | 0.23% | 18.1 |
| I | 0.34% | 15.9 |
| I | 0.57% | 13.4 |

EXAMPLE 7

(Comparative)

In order to impart long term storage stability to the concentrate of Example 6 an appropriate amount of Bentone 38 can be added. However this will increase the viscosity of the composition.

EXAMPLE 8

(Comparative)

A concentrate similar to example 6 can be made using, instead of the comminuted gel polymer, a bead polymer made by reverse phase bead polymerisation followed by azeotropic distillation and separation of the beads from the oil in which they were formed. This concentrate will generally require the addition of Bentone 38 or other dispersion promoter in order to impart storage stability to it.

EXAMPLE 9

A copolymer of 75 parts by weight acrylamide and 25 parts by weight of trimethyl 8-acryloxyethyl ammonium chloride was first prepared in a hydrocarbon liquid of boiling range 154°–168° C. (Shell SBP11) by conventional reverse phase polymerisation as follows. 287.4 gms of a 52.2% aqueous solution of acrylamide, 0.05 g of azo-bis-isobutyronitrile and 160.2 gms of water were mixed to form a solution whose pH was adjusted to 4.6 with sodium hydroxide solution (46% wt/wt) and then 71.0 gms of a 70.4% aqueous solution of trimethyl β-acryloxyethyl ammonium chloride was mixed in to form the aqueous monomer solution. An oil phase was prepared comprising 363.3 gms of SBP11, 14.2 gms at a 2 to 1 molar copolymer of stearyl methacrylate and methacrylic acid as suspension polymerisation stabiliser (as described in GB No. 1,482,515) and 7.8 gms Span 80.

The aqueous phase was homogenised with the oil phase and deoxygenated with nitrogen gas then polymerised by stirring in 1.5 mls of a 5% solution of sodium metabisulphite in water followed by a 1% solution of tertiary butyl hydroperoxide in SBP11 added at a rate of 0.25 mls per minute until polymerisation was complete.

The resulting aqueous polymer gel dispersion was azeotropically dehydrated under reduced pressure by recycling the SBP11. Part of the SBP11 was then distilled off resulting in an anhydrous polymer dispersion at a concentration of 40% polymer by weight in SBP11.

250 gms of this 40% copolymer dispersion was mixed with 500 gms of alkenyl succinic anhydride and subject to distillation under reduced pressure to remove the SBP11. Final distillation conditions were 95° C. at a pressure of 10 Torr. The resultant product was a stable dispersion of 100 grams polymer in 500 grams liquid reactive size. It could be rendered self emulsifying by the addition of high HLB surfactants.

EXAMPLE 10

The concentrate described in Example 9 was used to prepare a corresponding aqueous emulsion, having a 1% by weight active size content, by stirring the appropriate amount of dispersion into water. This emulsion was further diluted to 0.1% by weight active size content and labelled J.

As control, a conventional alkenyl succinic anhydride emulsion was prepared as follows. A 12% aqueous dispersion of a cationic starch was cooked at 95° C. for 20 minutes with constant stirring. The cooked starch was cooled and diluted to 9% activity. 2 parts by weight of alkenyl succinic anhydride was added to 3 parts by weight of cationic starch with agitation. High shear mixing with a Silverson mixer was continued to achieve a fine particle size emulsion. This emulsion was diluted with water to 0.1% by weight active size content and labelled K.

100 g.s.m. handsheets were prepared from a bleached sulphate/bleached birch stock containing 10% calcium carbonate loading on standard laboratory sheet making machine. Prior to sheet formation, the required amount of 0.1% emulsion labelled J was added to 600 mls of 1.0% consistency stock. After stirring, handsheets were prepared, pressed at 50 p.s.i. for 5 minutes prior to drying at 110° C. for 1 hour. After conditioning at room temperature, the degree of sizing was determined by the standard 1 minute cobb test.

Control sheets were prepared in the same manner as described above, but with emulsion K replacing emulsion J. The results are shown below:

| Emulsion | Dose Level of Alkenyl Succinic Anhydride Based on Dry Fibre and Filler | 1 Minute Cobb Value ($g \cdot m^{-2}$) |
|---|---|---|
| J | 0.25% | 22.1 |
| J | 0.35% | 16.4 |
| J | 0.5% | 13.7 |
| K | 0.25% | 27.2 |
| K | 0.35% | 20.1 |
| K | 0.5% | 15.6 |

We claim:

1. A concentrate composition suitable, upon dilution with water, for sizing cellulosic fibres and which comprises a substantially anhydrous dispersion of particles of water soluble cationic or anionic polyelectrolyte in a non-aqueous liquid comprising a reactive size and which contains water in an amount of 0 to 5% by weight of the total composition and which has been made by a process forming a dispersion in a water immiscible non-aqueous hydrophobic liquid of the polyelectrolyte particles while they are swollen by water, dehydrating the dispersion of polyelectrolyte particles swollen by water by azeotropic distillation until the dispersion is substantially anhydrous and dissolving the reactive size into the non-aqueous hydrophobic liquid of the resultant dehydrated dispersion, and in which the reactive size is selected from ketene dimer sizes and anhydride reactive sizes and the water soluble polyelectrolyte is selected from water soluble polymers of (a) cationic polymers formed from one or more ethylenically unsaturated monomers comprising a cationic ethylenically unsaturated monomer, (b) anionic polymers formed from one or more ethylenically unsaturated monomers comprising an ethylenically unsaturated carboxylic monomer or an ethylenically unsaturated sulphonic acid monomer, (c) polyamines, (d) dicyandiamide condensates and (e) polyimines.

2. A composition according to claim 1 containing at least one stabiliser for the aqueous polyelectrolyte particles in the hydrophobic liquid selected from water in oil emulsifiers and amphipathic polymeric dispersion stabilisers selected from oil soluble copolymers of one or more hydrophobic ethylenically unsaturated monomers with one or more hydrophilic ethylenically unsaturated monomers.

3. A composition according to claim 1 including amphipathic polymeric dispersion stabiliser selected from oil soluble copolymers of one or more hydrophobic ethylenically unsaturated monomers with one or more hydrophilic ethylenically unsaturated monomers.

4. A composition according to claim 1 in which the particles have a dry particle size of below 3 μm.

5. A composition according to claim 1 in which the concentration of the reactive size is from 30 to 85% by weight of the composition and the weight ratio polyelectrolyte:size is from 1:1 to 1:10.

6. A composition according to claim 1 in which the polyelectrolyte is selected from polymers formed from at least one monomer selected from dialklaminoalkyl (meth) acrylates and (meth) acrylamides and their acid addition salts and their quaternary ammonium salts, diallyl dialkyl ammonium chlorides, acrylic acid, methacrylic acid and 2-acrylamido-2-methyl propane sulphonic acid.

7. A composition according to claim 1 additionally including an oil-in-water emulsifier.

8. A composition according to claim 1 in which the said non-aqueous liquid comprises a solution of the size in the hydrophobic liquid and the ratio hydrophobic liquid:size by weight is 1:10 to 1:0.67.

9. A composition according to claim 1 in which the reactive size ia a liquid reactive size and the said non-aqueous liquid consists essentially of the said liquid reactive size and the composition has been made by a process comprising the additional step of removing the said hydrophobic liquid after the addition of the size to the hydrophobic liquid.

10. A comparison according to claim 1 in which the dispersion of polyelectrolyte particles swollen by water in the hydrophobic liquid has been formed by reverse phase polymerisation of aqueous ethylenically unsaturated monomer while dispersed in the hydrophobic liquid.

11. A process of making a concentrate composition suitable, upon dilution with water, for sizing cellulosic fibres and comprising forming a dispersion in a water immiscible non-aqueous hydrophobic liquid of particles of water soluble cationic or anionic polyelectrolyte particles swollen by water, dehydrating the dispersion of polyelectrolyte particles swollen by water by azeotropic distillation until the dispersion is substantially anhydrous and dissolving into the hydrophobic liquid a reactive size, the resultant composition having a water content of from 0 to 5% by weight and in which the reactive size is selected from ketene dimer sizes and anhydride reactive sizes and the water soluble polyelectrolyte is selected from water soluble polymers of (a) cationic polymers formed from one or more ethylenically unsaturated monomers comprising a cationic ethylenically unsaturated monomer, (b) anionic polymers formed from one or more ethykenically unsaturated monomers comprising an ethylenically unsaturated carboxylic monomer or an ethylenically unsaturated sulphonic acid monomer, (c) polyamines, (d) dicyandiamide condensates and (e) polyimines.

12. A method according to claim 11 in which the dispersion in the hydrophobic liquid of the polyelectrolyte particles swollen by water is formed in the presence of at least one stabiliser selected from water in oil emulsifiers and amphipathic polymeric dispersion stabilisers selected from oil soluble copolymers of one or more hydrophobic ethylenically unsaturated monomers with one or more hydrophilic ethylenically unsaturated monomers.

13. A method according to claim 11 in which the polyelectrolyte particles are stabilised in the dispersion by amphipathic polymeric dispersion stabiliser selected from oil soluble copolymers of one or more hydrophobic ethylenically unsaturated monomers with one or more hydrophilic ethylenically unsaturated monomers.

14. A method according to claim 11 in which the polyelectrolyte particles in the composition have a dry particle size below 3 μm.

15. A method according to claim 11 in which the reactive size is a liquid size and the hydrophobic liquid is removed after the addition of the liquid size to the hydrophobic liquid.

16. A method according to claim 11 in which the dispersion in the hydrophobic liquid of the polyelectrolyte particles swollen by water is formed by dispersing an aqueous solution of the polyelectrolyte into the hydrophobic liquid.

17. A method according to claim 11 in which the dispersion in hydrophobic liquid of the polyelectrolyte particles swollen by water is formed by reverse phase polymerisation of aqueous ethylenically unsaturated monomer while dispersed in the hydrophobic liquid.

* * * * *